US006244910B1

(12) United States Patent
Grubbs

(10) Patent No.: US 6,244,910 B1
(45) Date of Patent: Jun. 12, 2001

(54) ELECTRICAL BOX CONTACT WITH STRESS LIMITATION

(75) Inventor: Jimmy Glenn Grubbs, Walkertown, NC (US)

(73) Assignee: Tyco Electronics Corporation, Wilmington, DE (US)

( * ) Notice: Subject to any disclaimer, the term of this patent is extended or adjusted under 35 U.S.C. 154(b) by 0 days.

(21) Appl. No.: 09/564,873

(22) Filed: May 4, 2000

(51) Int. Cl.[7] ..... H01R 11/22; H01R 13/11
(52) U.S. Cl. ..... 439/852; 439/595; 439/748
(58) Field of Search ..... 439/852, 748, 439/851, 595

(56) References Cited

U.S. PATENT DOCUMENTS

| | | | | |
|---|---|---|---|---|
| 5,281,175 | | 1/1994 | Chupak et al. | 439/839 |
| 5,443,592 | * | 8/1995 | Ittah et al. | 439/851 |
| 5,540,603 | * | 7/1996 | Fujiwara | 439/851 |
| 5,575,696 | | 11/1996 | Endo et al. | 439/852 |
| 5,624,283 | * | 4/1997 | Hotea | 439/751 |
| 5,672,084 | * | 9/1997 | Feldman | 439/852 |
| 5,690,517 | | 11/1997 | Betsui | 439/839 |
| 5,839,925 | * | 11/1998 | Simmons | 439/852 |
| 5,941,741 | | 8/1999 | Dobbelaere et al. | 439/852 |
| 6,024,612 | * | 2/2000 | Myer et al. | 439/852 |

* cited by examiner

*Primary Examiner*—Brian Sircus
*Assistant Examiner*—Hae Moon Hyeon

(57) ABSTRACT

A box receptacle contact or terminal 10 is used in an electrical connector 2, typically of type employing multiple terminals 10. The box receptacle contact 10 has a cantilever spring contact beam 12 extending from a receptacle base 14. The spring contract arm 12 is reversely bent intermediate the ends of the spring contact beam to form a reversely bent section 20 at a forward portion of the spring contact arm 12. The spring contact beam is outwardly deflectable relative to the receptacle base 14 when mated with a mating contact 80, such as a blade or pin terminal. Two receptacle sidewalls 42, 44 are formed upwardly from the receptacle base 14 on opposite sides of the spring contact beam 12. Lateral projections 38, 40 extend from edges of the spring contact beam 12 between the cantilever spring base 16 and the reversely bent section 20. The lateral projections 38, 40 extend beneath the sidewalls 42, 44 to limit inward deflection of the spring contact beam 12 relative to the receptacle base 14. In this manner the cantilever contact beam. 12 is not be damaged or overstressed when the terminal 10 is inserted into a connector housing cavity 6.

20 Claims, 7 Drawing Sheets

ELECTRICAL BOX CONTACT WITH STRESS LIMITATION

BACKGROUND OF THE INVENTION

1. Field of the Invention

This invention is related to stamped and formed electrical connectors and to terminals or contacts that are used in those connectors. More particularly, this invention is related to box receptacle contacts or terminals and to means for preventing damage to compliant cantilever spring beams used in those terminal to generate a mating contact force between the terminal and a mating blade or pin terminal.

2. Description of the Prior Art

Stamped and formed box receptacle contacts or terminals are commonly used in applications such as automotive electrical systems to establish contact with pins or blades extending from a printed circuit board header or with other male terminals. These prior art stamped and formed box receptacles typically have sidewalls formed upwardly from a base with top wall extending from the sidewalls being formed inwardly to enclose a box receptacle portion of a terminal. A spring, generally in the form of a cantilever beam is formed from the base and when a male terminal is inserted between the cantilever beam and the top of the box contact section, deflection of the cantilever beam generates a mating force. Although the primary contact point can be on the top portion of these prior art terminals, it is the deflection of the cantilever beam that generates sufficient contact force to establish a reliable connector between the receptacle terminal and the blade. In other prior art terminals, the primary contact point is on the cantilever beam.

Many prior art receptacle terminals of this type are used in molded connector housings in which a molded latch extension is deflected as the terminal is inserted into a corresponding housing cavity. The molded latch extension then returns to a neutral position engaging a surface on the terminal to serve as a primary terminal latch. However, if the cantilever beam on the terminal is exposed, it can be damaged during insertion of the terminal into the housing. This problem can impose a lower limit on the strength of an exposed cantilever beam and can pose problems in generating the proper contact force without unduly increasing the mating force for multiposition connectors. For this reason reversely formed cantilever beams employed on some prior art terminals generally have relatively compliant beam sections that are not exposed on the exterior of the housing. However, for a relatively compliant beam, prior art connectors of this type generally employ relatively long beams located on the interior of the box receptacle. These long beams can, however, result in a primary contact point on the beam being spaced well back from the forward end of the terminal, in which case the terminal is only suitable for use with relatively long male terminals or blades.

SUMMARY OF THE INVENTION

The box receptacle contact or terminal comprising the representative embodiment of this invention is intended for use in an electrical connector, typically of the type employing multiple terminals. The box receptacle contact has a spring contact beam extending from a receptacle base. The spring contract arm is reversely bent intermediate the ends of the spring contact beam to form a reversely bent section at a forward portion of the spring contact arm. The spring contact beam is outwardly deflectable relative to the receptacle base when mated with a mating contact, such as a blade or pin terminal. Two receptacle sidewalls are formed upwardly from the receptacle base on opposite sides of the spring contact beam. At least one lateral projection extends from one edge of the spring contact beam between the base and the reversely bent section. The lateral projection or projections extend beneath one of the sidewalls to limit inward deflection of the spring contact beam relative to the receptacle base. In this manner the spring contact beam, in the form of a cantilever spring contact beam, cannot be damaged or overstressed if a force directed toward the interior of the box receptacle is applied to the beam, for example when the terminal is inserted into a connector housing. Conversely, this configuration permits the use of a more compliant or resilient beam, such a cantilever beam having a length that would otherwise make the cantilever beam subject to damage as the terminal is inserted into a connector housing.

The electrical connector with which terminals of this type can be used also includes a molded housing and the contact terminals are positioned in housing cavities. The housing has latches extending into the cavities to retain the contact terminals in the housing. The contact terminal spring beam is deflectable outwardly when mated to mating terminals to generate a mating force. The cantilever spring beam includes projections extending from opposite edges and abutting opposed surfaces when deflected inwardly to limit deflection in the second direction. These opposed surfaces can be edges of sidewalls adjacent to the cantilever spring beam. The contacts are insertable into the housing cavities with the latches on the housing engaging the cantilever spring beam and tending to deflect the cantilever spring beam in the second direction during insertion of the contact terminals into the housing cavities. If a terminal position assurance member abuts one of the housing latches, it could still be possible to insert the terminal into the housing cavity if the cantilever spring beam could be deflected inwardly by a distance sufficient to permit insertion of the terminal. However, the terminal could be damaged and the cantilever spring beam could be stressed to the point where it could no longer generate adequate or sufficient mating force to maintain and adequate interconnection.

The female electrical terminal according to this invention is suitable for use in establishing electrical connection with mating terminal blades of different lengths. This electrical receptacle terminal has a cantilever spring contact beam with a first section extending from a cantilever base to a reversely bent section located between the first section. A second section extends between the reversely bent section and a free end with a blade contact surface being located adjacent this end of the terminal. The second section extends at an acute angle relative to the first section. The first section includes a structure for limiting deflection of the cantilever spring contact beam due to forces applied to the first section and directed toward the second section.

DETAILED DESCRIPTION OF THE PREFERRED EMBODIMENT

Figure 1A:
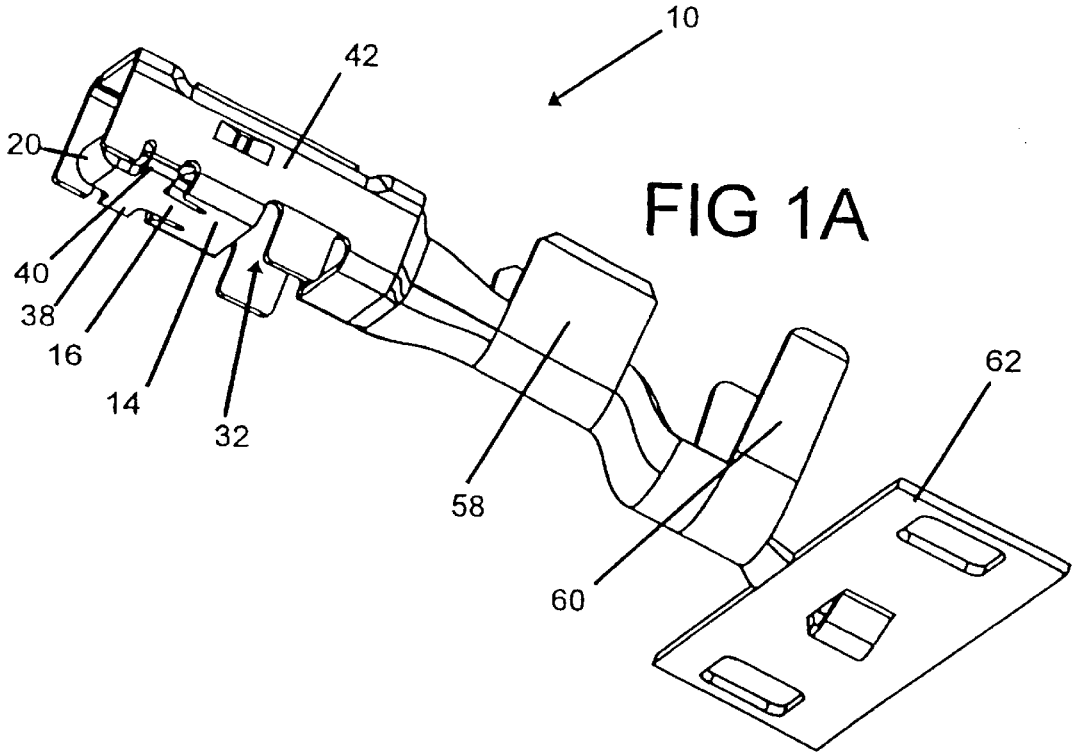
FIGS. 1A and 1B are three dimensional views of a stamped and formed electrical box receptacle contact or terminal comprising the preferred embodiment of this invention.

The box receptacle terminal or contact 10, comprising the preferred or representative embodiment of the invention described herein, is a female electrical contact or receptacle that is to be mated with a male pin or blade contact 80. The specific embodiment depicted herein is intended to mate with a blade terminal 80 having a width of 2.8 mm. This width is one of a number of standard blade terminal widths used in automotive electrical assemblies. Although this terminal width has been adopted as a standard by various groups including USCAR and ISO, the length of these terminals has not been specified and blades 80 having various lengths are currently employed. The box receptacle contact terminal 10 is therefore intended to mate with blades 80 having various lengths.

Figure 6:
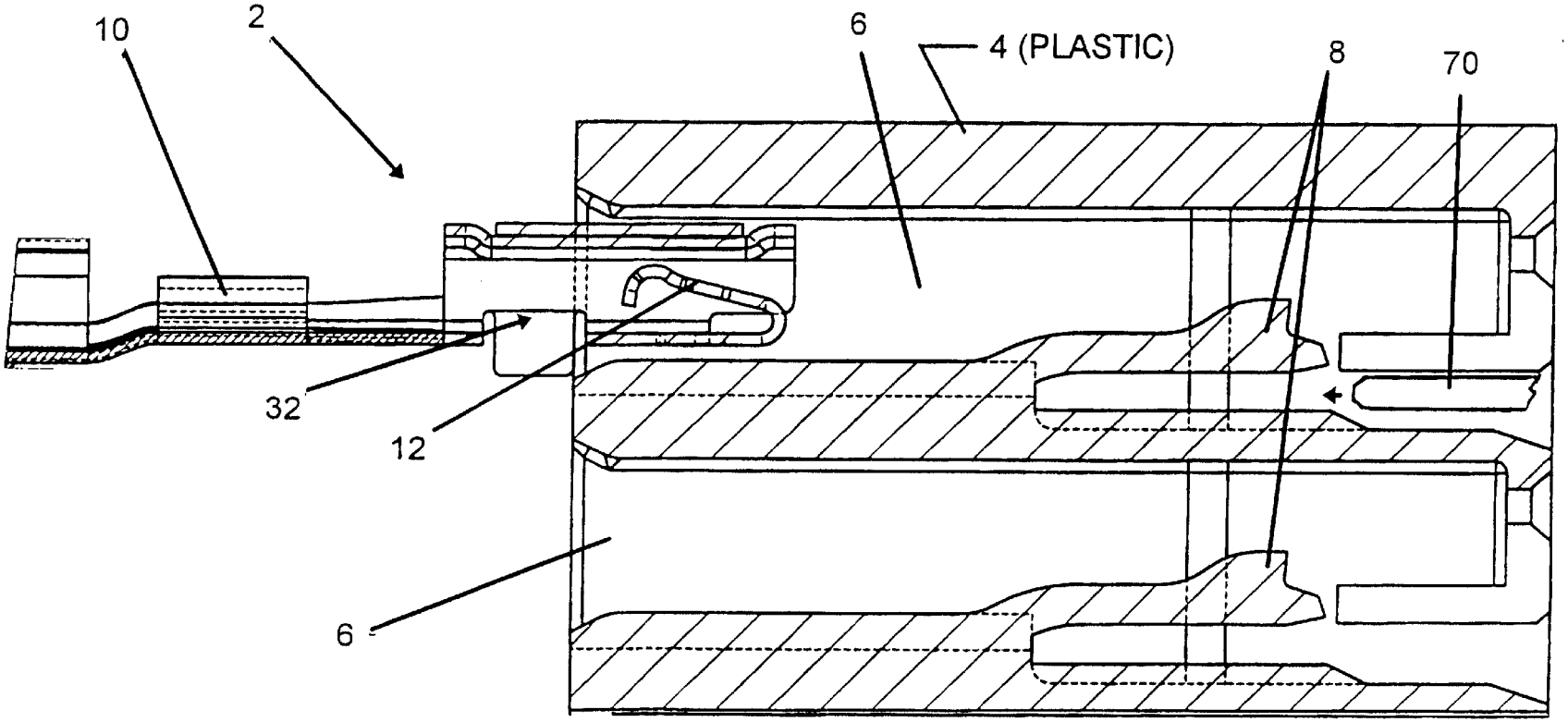
FIG. 6 is a view illustrating the manner in which the terminal of FIGS. 1–4 is inserted into a housing cavity to form and electrical connector.

Box receptacle terminals 10 are employed with a molded housing 4 to form an electrical connector 2 having a number of positions for multiple terminals. Each terminal or contact 10 is inserted into a housing cavity 6 from one end of the housing 4 and is retained in the housing cavity 6 by a deflectable molded latch 8 which forms a part of the molded housing 4 and which extends into a corresponding housing cavity 6. These latches 8 deflect to permit insertion of the terminal 10 into the housing cavity 6, and when the terminal 10 is fully inserted, the latch returns to its normal position engaging the terminal 10 to retain it in the proper position in the corresponding cavity 6. Typically, these terminals 10 are inserted into the rear end of the housing cavity 6 and are pushed toward the housing mating face. A terminal position assurance member 70, as shown in FIG. 6, can be inserted behind the latch 8 so that the latch 8 does not become dislodged from the terminal 10.

Figure 1B:
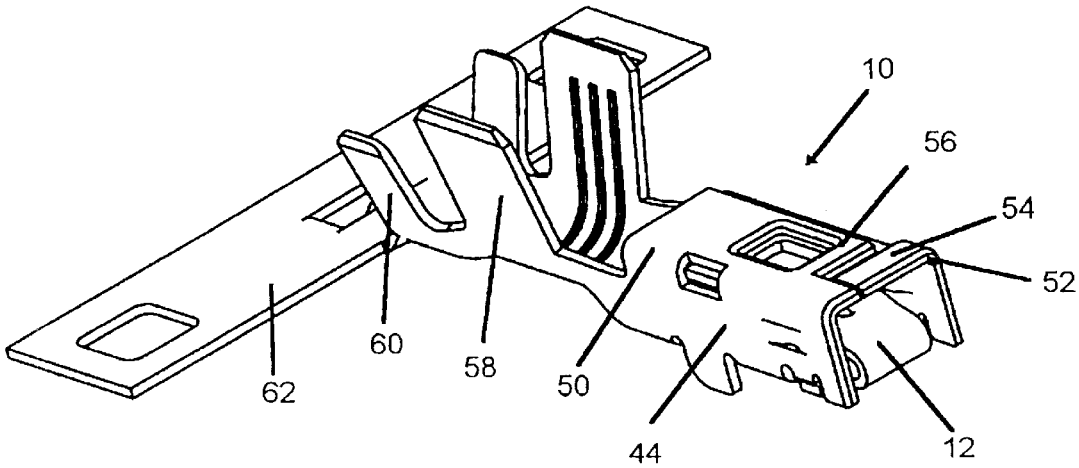
Figure 2:
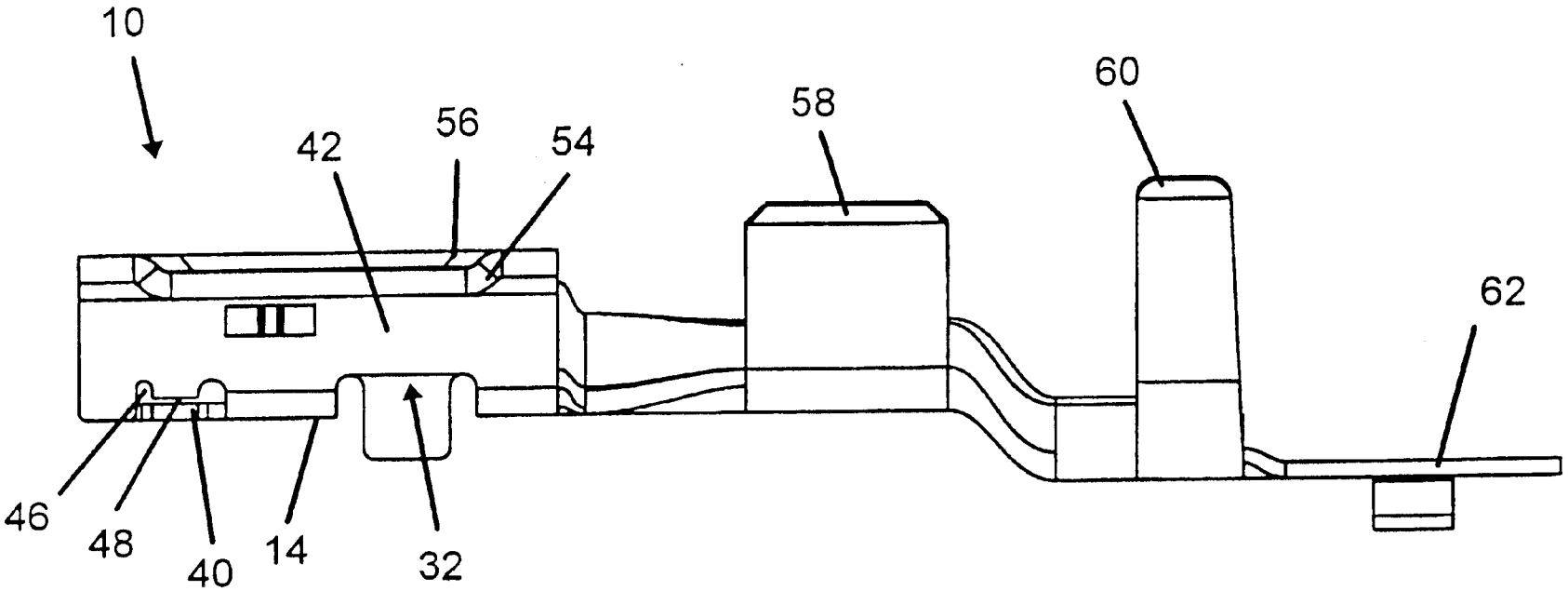
FIG. 2 is a side view of the box receptacle terminals shown in FIGS. 1A and 1B.
Figure 3:
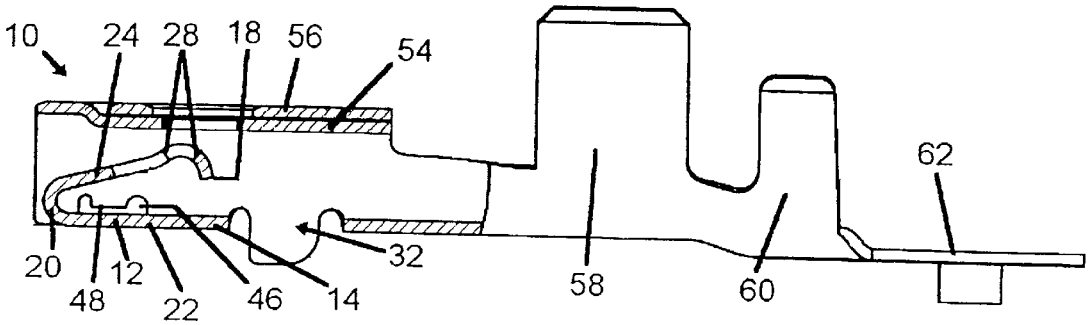
FIG. 3 is a partial longitudinal sectional view showing details of the receptacle contact portion of the terminals shown in FIGS. 1A and 1B.
Figure 5:
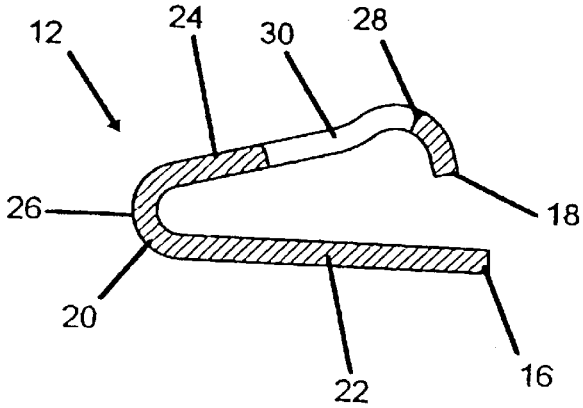
FIG. 5 is an enlarged longitudinal section view of the cantilever spring contact beam employed in the terminal shown in FIGS. 1–4.

As shown in FIGS. 1A and 1B, each stamped and formed receptacle terminal 10 has a contact or mating section which has a rectangular or box configuration. The terminals 10 are shown in FIGS. 1A and 1B in their stamped configuration attached to a carrier strip 62. This carrier strip 62 will be removed in a conventional fashion when the terminals 10 form parts of connectors 2. Although the terminal 10 can be inserted into the housing 4 in various orientations, certain conventions will be adopted here in order to describe the shape of the terminal 10 and its relationship to the housing 4. For instance the box receptacle contact or terminal 10 will be said to have a lower surface including a receptacle base 14 and an upper surface having two overlapping top walls 54 and 56. However, characterization of a receptacle base 14 and top walls 54, 56 does not imply that the terminals 10 can only be inserted in one orientation. Similarly the terminal 10 has a front end through which mating blade terminals 80 are inserted and a rear end from which wires, not shown, crimped to the conventional wire crimp sections 58 and insulation crimp sections 60 will extend. The area bounded by the receptacle base 14, two sidewalls 42, 44 and two top walls 54, 56 will be referred to as the interior of the terminal 10 as opposed to the exterior of the terminal 10 which will be positioned adjacent to the walls of corresponding housing cavities 6 when positioned in the housing 4.

Figure 4:
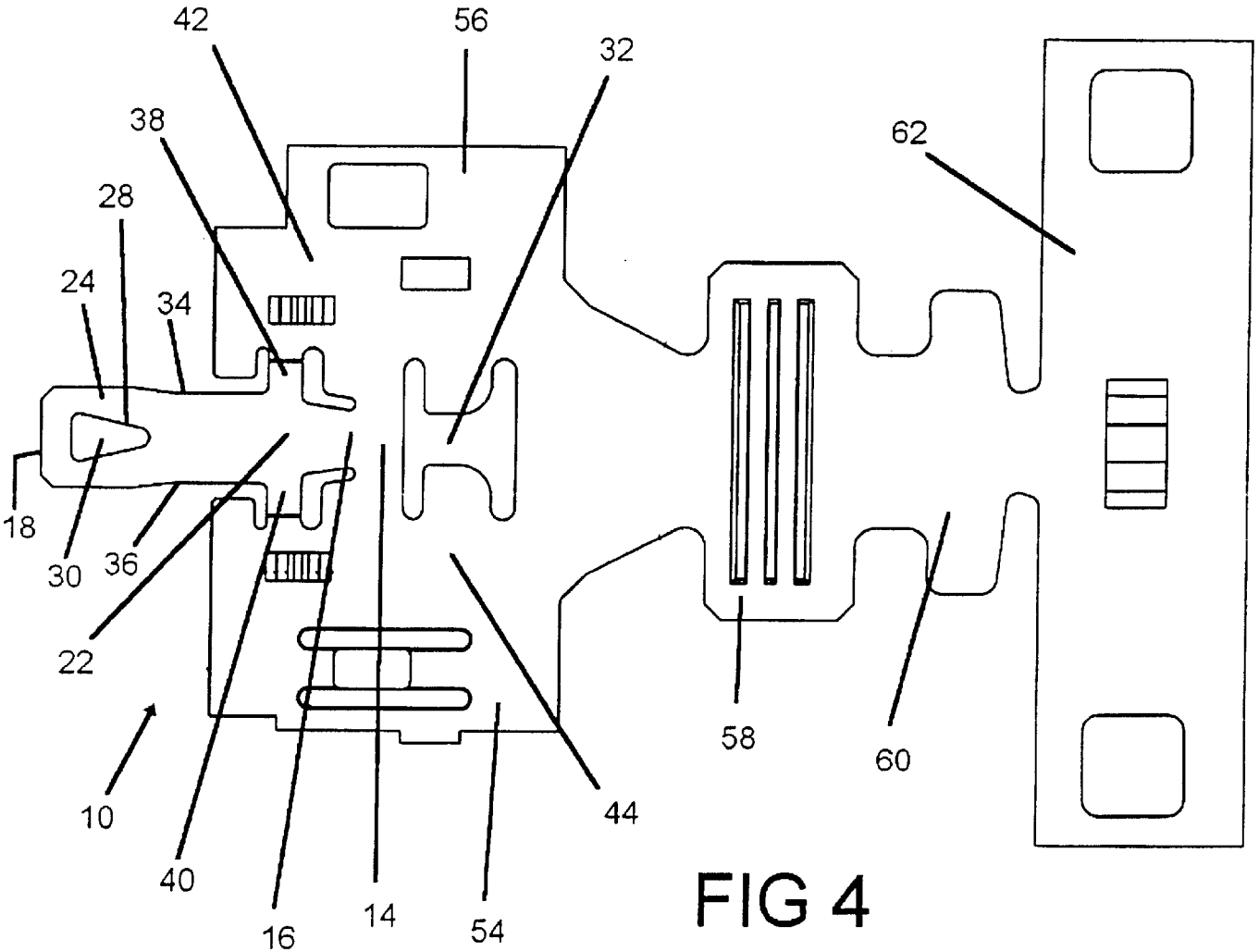
FIG. 4 is a view of the stamped blank from which the box receptacle contact of FIGS. 1A and 1B is formed.

Box receptacle contact 10 includes a compliant or resilient cantilever spring beam 12, which when flexed, generates suitable mating force to establish reliable electrical contact with a mating blade terminal 80 inserted into the interior of the receptacle box. In the preferred embodiment, the terminal 10 includes a bright tin plating, but this invention can be employed with other types of electroplated terminals. The cantilever spring beam base 16 joins the receptacle base 14 and the cantilever spring beam 12 extends forward form the receptacle base 14. The first section of the cantilever beam 12 extends substantially in the same plane as the receptacle base 14 when the spring beam 12 is in its neutral configuration. This first section 22 of the cantilever beam 12 extends to a reversely bent intermediate section 20 which is located a the forward end of the receptacle terminal 10 and comprises the forward or leading end 26 of the cantilever spring beam 12 when the terminal 10 is inserted into a housing cavity 6. A second section 24 extends rearwardly from the opposite end of the reversely bent section 20 toward the distal or free end 18 of the cantilever spring beam 12. The second beam section 24 extends at an acute angle relative to the first beam section 22. The second beam section 24 has an aperture 30 that as shown in FIG. 4 as a generally triangular shape with the broad base adjacent the distal end 18. When the beam 12 is reversely bent, the distal end 18 will be located at the rear of the spring beam 12 and the width of the aperture 30 will therefore increase toward the rear of the terminal 10. A crowned section is formed adjacent the beam distal end 18 and the widest part of the aperture 30 extends into this crowned section, which comprises the innermost or highest portion of the spring beam 12. When a blade 80 is inserted into engagement with cantilever spring beam 12, the blade 80 will engage blade contact surfaces 28 on opposite edges of the aperture 30, thus forming four points or areas of contact with the beam 12.

Although the aperture 30 will result in greater compliancy in the second beam section 24, the spring contact force between the beam 12 and the blade 80 is not due solely to the deflection of the second beam section 24. The first beam section 22 is also a compliant member and will also deflect when the blade 80 is inserted into engagement with the cantilever spring beam 12. The cantilever base 16 is located approximately below the contact surfaces 28 which the blade 80 will engage. This results in a long compliant beam section 22 extending between the cantilever base 16 and the reversely bent forward section 20. In order to add additional compliancy to the spring beam section 22, the edges forming the portion of the beam adjacent to the cantilever base 16 are inwardly tapered so that the width of the beam at the cantilever base 16 is less than the width of the remaining portions of the beam. This rearwardly extending, inwardly tapered portion of the beam extends from two lateral projections 38, 40 to the cantilever base 16. The two lateral projections 38, 40 form the widest portion of the beam, although the width of the beam between the lateral projections 38, 40 is still greater than the beam width at the cantilever base 16. These lateral projections 38, 40 extend from opposite beam edges 34, 36 and comprise deflection limiting means that will prevent excessive inward deflection of the beam 12 and of the first beam section 22 when the terminals 10 are inserted into the housing cavities 6 past the housing latches 8. The manner in which these lateral projections limit deflection will be described in greater detail after description of the remaining portions of the box receptacle contact or terminal 10.

As shown in FIGS. 1A and 1B, two opposite sidewalls 42, 44 extend upwardly form the receptacle base 14, which is joined to the sidewalls 42, 44 between the cantilever beam base 16 and an opening 32 located to the rear of cantilever spring beam 12. This opening 32 is dimensioned to receive the connector housing latch 8 and this latch 8 can return to its neutral, retention position when the terminal 10 is fully inserted into it corresponding housing cavity 6 to align the latch 8 with the opening 32. Although the sidewalls 42 and 44 are also joined to a tapered section extending to the crimp section 58, the stresses due to deflection of the spring beam 12 will be confined to the beam itself and to the portion of the receptacle base 16 extending from the cantilever base 16 to the opening 32.

When formed upwardly from the receptacle base 16, the two sidewalls 42, 44 will be substantially parallel and will be located on opposite sides of the cantilever beam 12. These sidewalls 42, 44 will extend upwardly past the top portion of the spring beam 12 and two overlapping top walls 54, 56 will be bent inwardly from top edges 50, 52 of the sidewalls 42, 44 to form an enclosed rectangular box. The uppermost portion of the spring beam 12 will be positioned relative to the top walls 54, 56 so that when a blade terminal 80 is inserted into the space between the beam 12 and the top walls 54, 56, the blade 80 will be in contact with these opposed surfaces and adequate contact force will be developed by deflection of the cantilever spring beam 12, including deflection of the first and second sections 22, 24.

Figure 8:
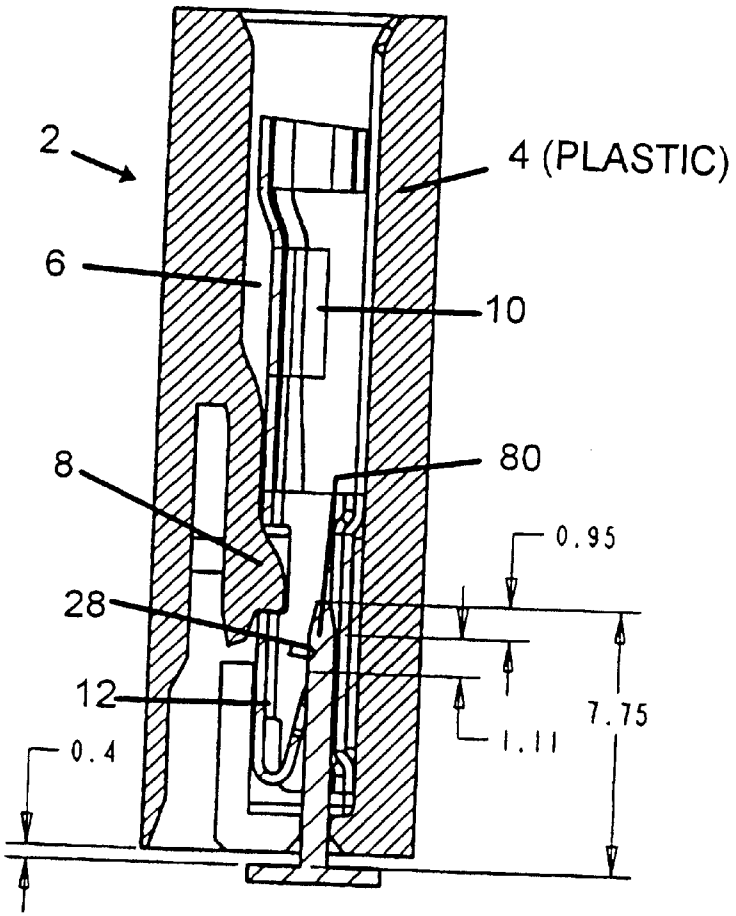
FIGS. 7–10 are views showing the manner in which the connector of FIG. 6 and the terminal shown in FIGS. 1–6 can be used with mating blade terminals of different standard lengths.
Figure 7:
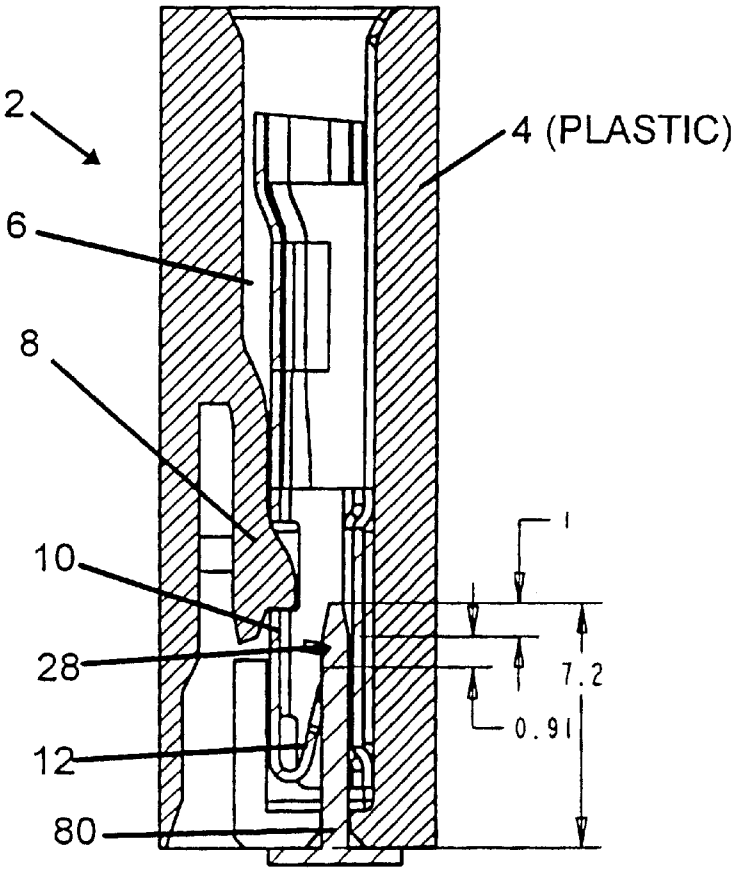
Figure 10:
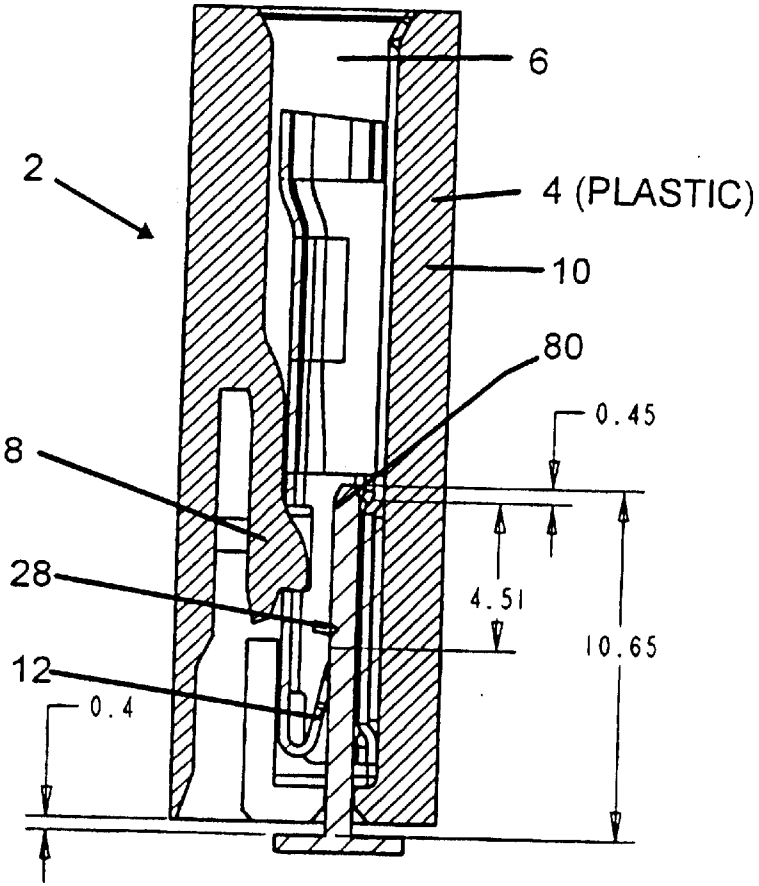
Figure 9:
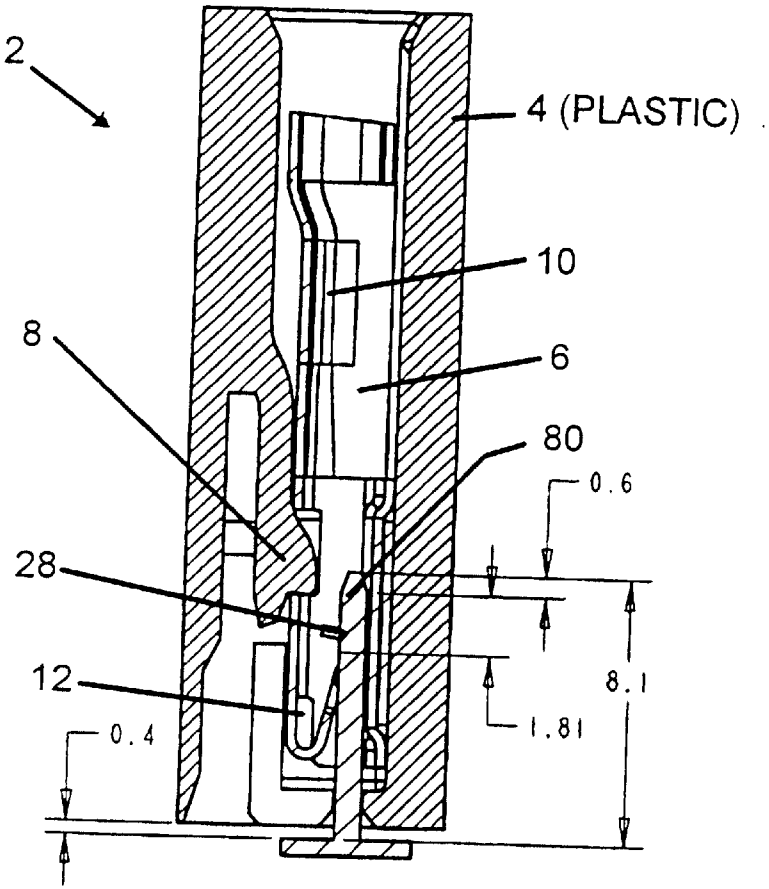

Each sidewall 42, 44 includes a notch section 46 having a lower notch edge 48 that is aligned with adjacent lateral beam projections 38, 40. As seen in FIG. 4, the lateral projections 38, 40 are stamped from the recessed notch sections 46. When the sidewalls 42, 44 are formed at substantially right angles to the receptacle base 14, the lower notch edges 48 will be positioned immediately above the lateral projections 38, 40. These notch edges 48 will therefore comprise opposed surfaces that will limit upward movement of the projections 38, 40 and thus will limit inward deflection of the cantilever beam 12 by limiting inward deflection of the compliant beam section 22. When a blade terminal 80 is inserted into the interior of the box receptacle 10, this first section 22 will be deflected outwardly, away from the opposed surfaces 48, to provide space for insertion of the blade 80. However, a force will act on the first beam section 22 during insertion of the terminal 10 into the housing cavity 6 as the latch engages the exterior of beam section 22 before the latch moves into alignment with the latch opening 32. This inwardly directed force will not be sufficient to damage or overstress the compliant or resilient cantilever spring beam 12, because the lateral projections 38, 40 opposed to surfaces or edges 48 will act as limit stops preventing excessive inward deflection. Although these spring beams 12 would not normally be damaged by insertion of the terminal 10 into engagement with housing latches 8, in certain situations damage can occur. For example, if a terminal position member 70, of the type shown in FIG. 6, were positioned behind the latch 8, preventing its deflection, the cantilever beam could be overstressed when an installer unknowingly forced the terminal into its fully inserted position. Although one solution to that problem could be to make the second beam section 24 longer to generate the required mating force, FIGS. 7–10 illustrate the problem with that alternative, where significant interface dimensions for several conventional blade configurations are shown in mm. In order to mate with shorter blade terminals, such as shown in FIGS. 7 and 8, the contact point must be relatively close to the mating end of the connector 2. If excessive mating force were applied by a relative short beam, then the contact interface could be damaged when relatively long blades, such as those shown in FIGS. 9 and 10 are mated with connectors of this type. This relative long travel could also increase mating force, and excessive mating force is generally a problem when connectors having relative large terminal counts are employed. This invention, however, solves this problem by using a relatively long and compliant spring beam, with the principal contact point located adjacent to the mating face and with the lateral projections 38, 40 together with opposed surfaces 48 serving to limit inward travel of the cantilever spring beam 12 without adversely affecting mating and contact performance.

The receptacle terminal and connector described in the preferred embodiment of this invention comprises a preferred embodiment of the invention. Alternative embodiments could also include the main elements of this invention. For example the opposed surfaces which limit movement of the lateral projections could be located on a separate terminal component or on the walls of the housing cavities. Other alternative embodiments would also be apparent to one of ordinary skill in the art. Therefore, this invention is defined by the following claims and is not limited to the representative embodiment disclosed herein.

I claim:

1. A box receptacle contact for use in an electrical connector comprising:

a spring contact beam extending from a receptacle base, the spring contact beam being reversely bent between ends of the spring contact beam to form a reversely bent section at a forward portion of the spring contact beam, the spring contact beam being outwardly deflectable relative to the receptacle base when mated with a mating contact;

first and second receptacle sidewalls formed upwardly from the receptacle base on opposite sides of the spring contact beam; and at least one lateral projection extending from an edge of the spring contact beam between the base and the reversely bent section, the lateral projection extending beneath one of the sidewalls to limit inward deflection of the spring contact beam relative to the receptacle base.

2. The box receptacle contact of claim 1 wherein projections extend laterally from opposite edges of the spring contact beam and extend beneath the first and second receptacle sidewalls.

3. The box receptacle contact of claim 2 wherein the spring contact beam is inwardly tapered from the lateral projections so the spring contact beam is narrower at a juncture of the spring contact beam and the base than adjacent the lateral projections.

4. The box receptacle contact of claim 2 wherein a notch section is formed in each receptacle sidewall, the notch sections having a lower edge recessed relative to adjacent sections of the sidewalls, and wherein the lateral projections extend beneath the notched sections.

5. The box receptacle contact of claim 4 wherein the notch sections are recessed above the receptacle base.

6. The box receptacle contact of claim 2 wherein the spring contact beam extends from the reversely bent section adjacent the forward portion, upwardly and rearwardly to a contact surface adjacent a free end of the spring contact beam, the contact surface and the juncture of the spring contact beam and the base both being positioned rearwardly relative to the lateral projections.

7. The box receptacle contact of claim 6 wherein the spring contact beam includes an aperture between the reversely bent section at the forward portion and the free end to form a contact surface with four points of contact with a mating terminal.

8. The box receptacle contact of claim 2 wherein a opening in the receptacle base is located behind the spring contact beam.

9. The box receptacle contact of claim 8 wherein stress in the receptacle base due to deflection of the spring beam contact are confined to the area between the first and second sidewalls and the opening.

10. The box receptacle contact of claim 2 wherein the overlapping top walls, extending from top edges of the first and second sidewalls form a top enclosure of the box receptacle.

11. An electrical connector comprising a molded housing and contact terminals positioned in housing cavities, the housing including latches extending into the cavities to retain the contact terminals in the housing, wherein the contact terminals include a cantilever spring beam deflectable in a first direction when mated to mating terminals to generate a mating force, the cantilever spring beam including projections extending from opposite edges and abutting opposed surfaces overlapping the projections when deflected in a second direction to limit deflection in the second direction, the contact terminals being insertable into the housing cavities with the latches on the housing engaging the cantilever spring beam and deflecting the cantilever spring beam in the second direction during insertion of the contact terminals into the housing cavities.

12. The electrical connector of claim 11 wherein the opposing surfaces are located on the contact terminals.

13. The electrical connector of claim 11 wherein the contact terminals comprise receptacle terminals.

14. The electrical connector of claim 13 wherein the receptacle terminals comprise box receptacles having sidewalls extending adjacent to the cantilever spring beam, which extends from a receptacle base.

15. The electrical connector of claim 14 wherein the opposing surfaces are located on edges of the sidewalls adjacent to the receptacle base.

16. The electrical connector of claim 11 wherein the contact terminals include openings into which the housing latches extend to engage the contact terminals for retention in the housing cavities, the openings being located adjacent to a base of the cantilever spring beams.

17. The electrical connector of claim 11 wherein each cantilever spring beam extends from a cantilever base to a reversely bent forward section, the cantilever spring beam extending rearwardly from the forward section to a free end of the cantilever spring beam, the projections being located between the cantilever base and the reversely bent forward section.

18. The electrical connector of claim 17 wherein the reversely bent forward sections comprise leading ends of the contact terminals as the contact terminals are inserted into the housing cavities.

19. The electrical connector of claim 11 further comprising a terminal position assurance member engagable with the housing latches to prevent deflection of the housing latches.

20. A female electrical terminal suitable for use in establishing electrical connection with mating terminal blades of different lengths, the electrical receptacle terminal comprising:

a cantilever spring contact beam having a first section extending from a cantilever base to a reversely bent section located between the first section and a second section, which extends between the reversely bent section and a distal end with a blade contact surface being located adjacent the distal end, the first section being more compliant than the second section, which extends at an acute angle relative to the first section; and means on the first section for limiting deflection of the cantilever spring contact beam due to forces applied to the first section and directed toward the second section.

* * * * *